US007553530B2

(12) United States Patent
Chen

(10) Patent No.: US 7,553,530 B2
(45) Date of Patent: Jun. 30, 2009

(54) WAVED MESH TUBE

(76) Inventor: Ching Chen Chen, No. 257, Sec. 2, Wen Yuan Road, Pei Tou, Chang Hua Hsien (TW)

( * ) Notice: Subject to any disclaimer, the term of this patent is extended or adjusted under 35 U.S.C. 154(b) by 348 days.

(21) Appl. No.: 11/368,512

(22) Filed: Mar. 7, 2006

(65) Prior Publication Data

US 2007/0157409 A1 Jul. 12, 2007

(30) Foreign Application Priority Data

Jan. 11, 2006 (TW) ..... 95200659 U

(51) Int. Cl.
*B29D 22/00* (2006.01)
*B29D 23/00* (2006.01)
*B32B 1/08* (2006.01)

(52) U.S. Cl. ..... 428/36.92; 428/36.9; 428/35.2; 428/35.5; 428/36.3; 442/239; 442/268; 442/245; 15/229.1; 15/209.1; 15/208

(58) Field of Classification Search ..... 442/239, 442/268, 245; 15/229.1, 209.1, 208; 428/36.9, 428/36.92, 35.2, 35.5, 36.3
See application file for complete search history.

(56) References Cited

U.S. PATENT DOCUMENTS 5,630,245 A * 5/1997 Tuthill et al. ..... 15/229.11
5,916,408 A 6/1999 Chen ..... 156/308.4
2003/0236045 A1* 12/2003 Ching-Chen ..... 442/239

* cited by examiner

*Primary Examiner*—Michael C Miggins
(74) *Attorney, Agent, or Firm*—Troxell Law Office PLLC

(57) ABSTRACT

A waved mesh tube including multiple parallel first strings spirally extending in a first direction and multiple parallel second strings spirally extending in a second direction. The second strings are laid on the first strings. The mesh tube has continuous circles of waved bending sections arranged along an axis of the mesh tube. The mesh tube is formed with the bending sections so that the wall of the mesh tube has multiple wave crests and wave troughs adjoining each other. The wave troughs define an inner diameter of the mesh tube, while the wave crests define an outer diameter of the mesh tube. Each of the wave crests and the wave troughs has an acute angle. A difference between the inner diameter and the outer diameter is a thickness of the wall of the mesh tube. The wall of the mesh tube is waved and solid and has higher rigidity.

8 Claims, 7 Drawing Sheets

WAVED MESH TUBE

BACKGROUND OF THE INVENTION

The present invention is related to a mesh tube, and more particularly to a waved mesh tube from which a bath ball or bath brush is made. The wall of the mesh tube is thicker and has higher rigidity.

FIG. 1 shows a conventional mesh tube 10 from which a bath ball or bath brush is made. In FIG. 1, the mesh tube 10 is fitted around a phantom cylinder 12 for showing the structure of the mesh tube 10.

FIG. 2 is an enlarged sectional view of the mesh tube 10. The mesh tube 10 is made of plastic material by extrusion. The mesh tube 10 is composed of multiple parallel first strings 14 extending in a first direction and multiple parallel second strings 16 extending a second direction. The second strings 16 are laid on the first strings 14 and intersect the first strings 14.

Referring to FIG. 3, the mesh tube 10 is composed of a lower layer of strings 14 and an upper layer of strings 16 laid on the lower layer. Each string has a diameter of about 0.15~0.2 mm. Therefore, the mesh tube has a thickness of about 0.3~0.4 mm. The thickness of the conventional mesh tube is the total of the thickness of the upper layer and the thickness of the lower layer. Therefore, The inner diameter D of the mesh tube is nearly equal to the outer diameter O of the mesh tube. Accordingly, the thickness of the mesh tube is very thin so that the inner diameter and outer diameter of the mesh tube can be deemed equal. As a result, the mesh tube has unified diameter. The bath ball or bath brush made from such mesh tube is not compact.

Moreover, the conventional mesh tube 10 is quite soft without rigidity. In addition, the mesh tube 10 has a smooth surface. The bath ball or bath brush made from such mesh tube can hardly provide rubbing effect for a user's skin. That is, the aged skin cannot be rubbed off with such mesh tube.

U.S. Pat. No. 5,916,408 of this applicant discloses a measure employing two gears for rolling the mesh tube. However, the thickness of the mesh tube formed by the Patent is limited and no acute angle can be formed on the surface of the mesh tube. The wavy configurations of a tubular net disclosed by the patent are uniform in size. U.S. patent application Ser. No. 10/173,643 of this applicant does not disclose any mesh tube article.

SUMMARY OF THE INVENTION

It is therefore a primary object of the present invention to provide a mesh tube having waved, solid and thicker wall and having a distent volume.

It is a further object of the present invention to provide the above mesh tube with higher rigidity.

The present invention can be best understood through the following description and accompanying drawings wherein:

DETAILED DESCRIPTION OF THE PREFERRED EMBODIMENTS

Figure 5:
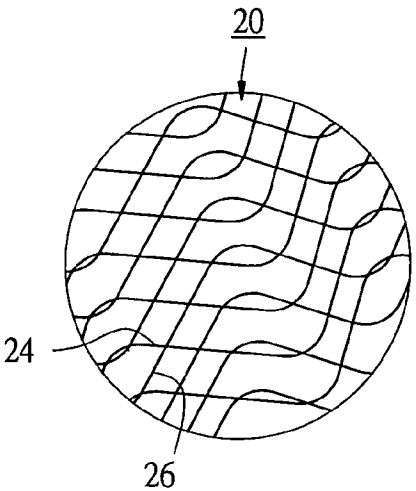
FIG. 5 is an enlarged view of circled area B of FIG. 4.
Figure 4:
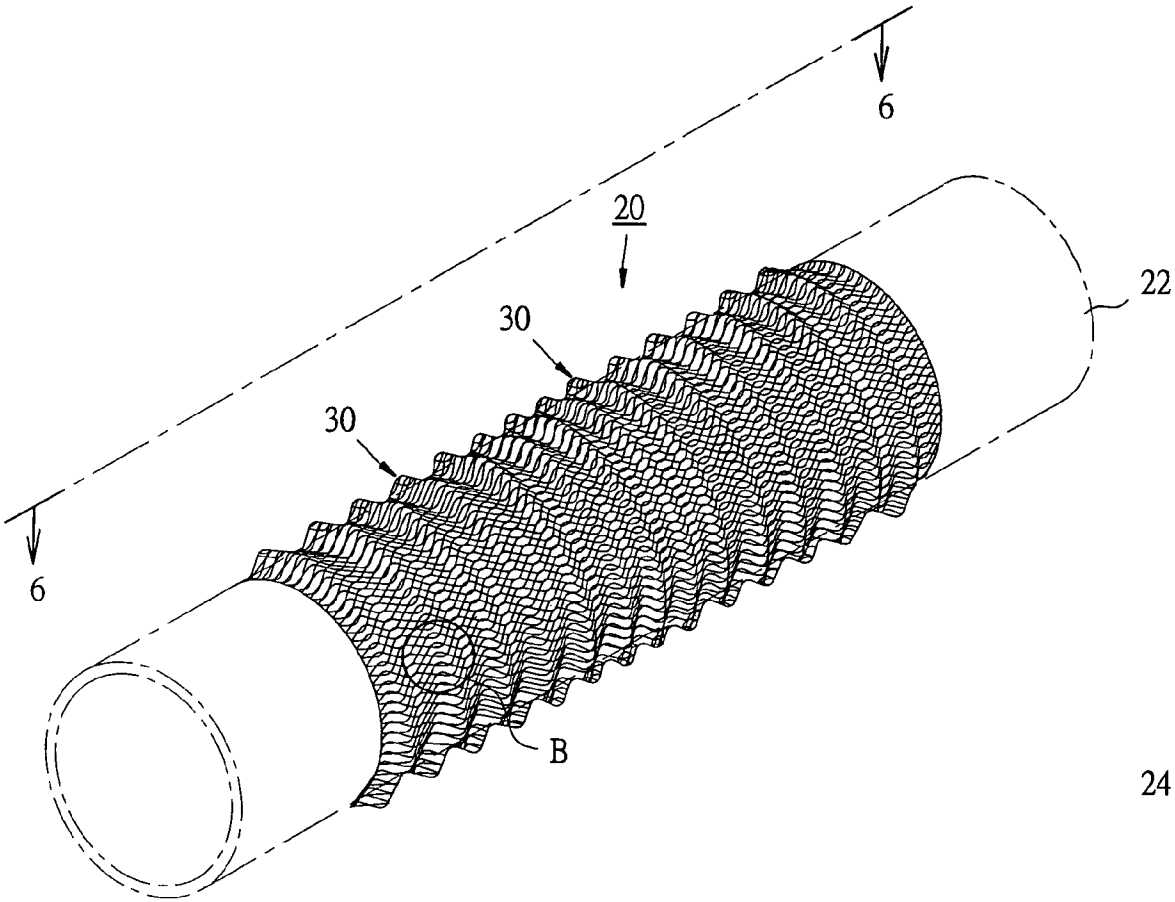
FIG. 4 is a perspective view of the waved mesh tube of the present invention fitted around a phantom cylinder.

Please refer to FIGS. 4 and 5. The mesh tube 20 of the present invention is fitted around a phantom cylinder 22 for describing and showing the structure of mesh tube 20. As the conventional mesh tube, the mesh tube 20 is composed of multiple parallel first strings 24 extending in a first direction and arranged at intervals and multiple parallel second strings 26 extending in a second direction and arranged at intervals. The second strings 26 are laid on the first strings 24. The first and second strings 24, 26 spirally extend to form the mesh tube 20.

The mesh tube 20 is extruded by a specific equipment at a temperature higher than room temperature and formed with a waved pattern. The mesh tube 20 is extensible and restorable to its original waved shape.

Figure 6:
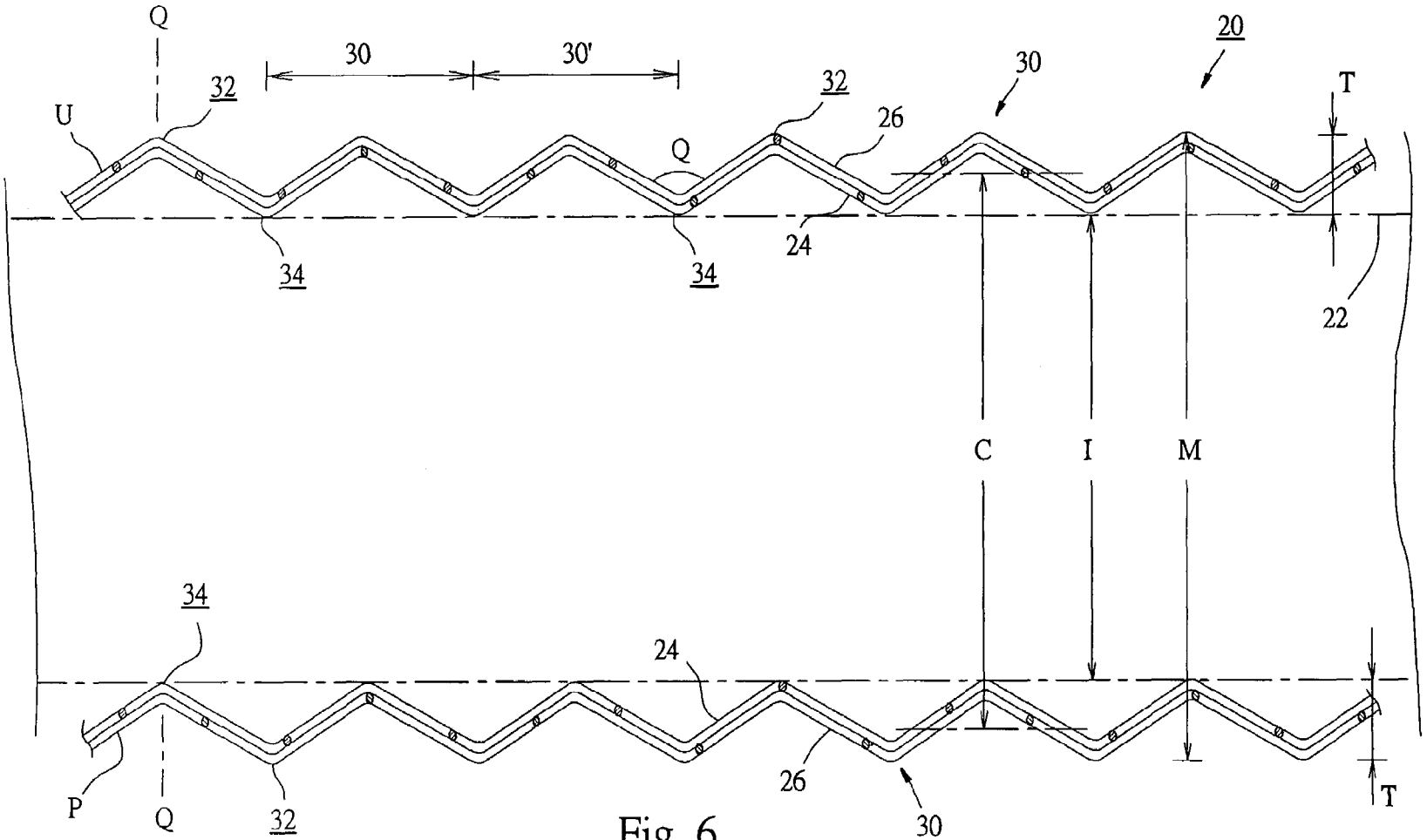
FIG. 6 is a sectional view taken along line 6-6 of FIG. 4.

The mesh tube 20 has continuous circles of waved bending sections 30 arranged along the axis of the mesh tube 20. The bending sections 30 are arranged along the entire length of the mesh tube. Referring to FIG. 6, the mesh tube 20 is formed with the bending sections 30 so that the mesh tube 20 has an inner diameter I, an outer diameter M and a middle diameter C. In addition, the mesh tube 20 is formed with the bending sections 30 so that the wall of the mesh tube has multiple wave crests 32 and wave troughs 34 adjoining each other. Each of the wave crests 32 and the wave troughs 34 has an acute angle which is generally a small-size arc.

The thickness of the wall of the conventional mesh tube 10 is very thin, which is only twice the thickness of the diameter of single string.

In contrast to the conventional mesh tube, the inner diameter I and the outer diameter M are considerably different in dimension. The difference between the inner diameter I and outer diameter M is the thickness T of the wall of the mesh tube, which is at least triple the diameter of single string, normally, five to eight times the diameter of the single string. Accordingly, the thickness of the wall of the mesh tube of the present invention is several times the thickness of the wall of the conventional mesh tube.

FIG. 6 shows that the bending sections are as large as each other. However, in practical product, the adjacent bending sections will have different sizes. For example, the bending section 30 may be different from the bending section 30' in size. That is, the wavelengths of the bending sections can be different, and/or the heights between the wave crest and the wave trough of the bending sections can be different. It can be known from the attached photograph of a real article of the present invention that the bending sections may be different in size. According to the real article, the thickness T of the mesh tube is 3-8 mm. The angle θ of the wave crest 32 or wave trough 34 is 60-120 degrees. The wavelength is 6-14 cm. In addition, refers to the attached photograph, the wall of the conventional mesh tube is straight, while the wall of the mesh tube of the present invention is solid. The structure of the mesh tube of the present invention is not limited to the above values. For example, the thickness of the wall or the bending sections of the mesh tube can be smaller.

Figure 1:
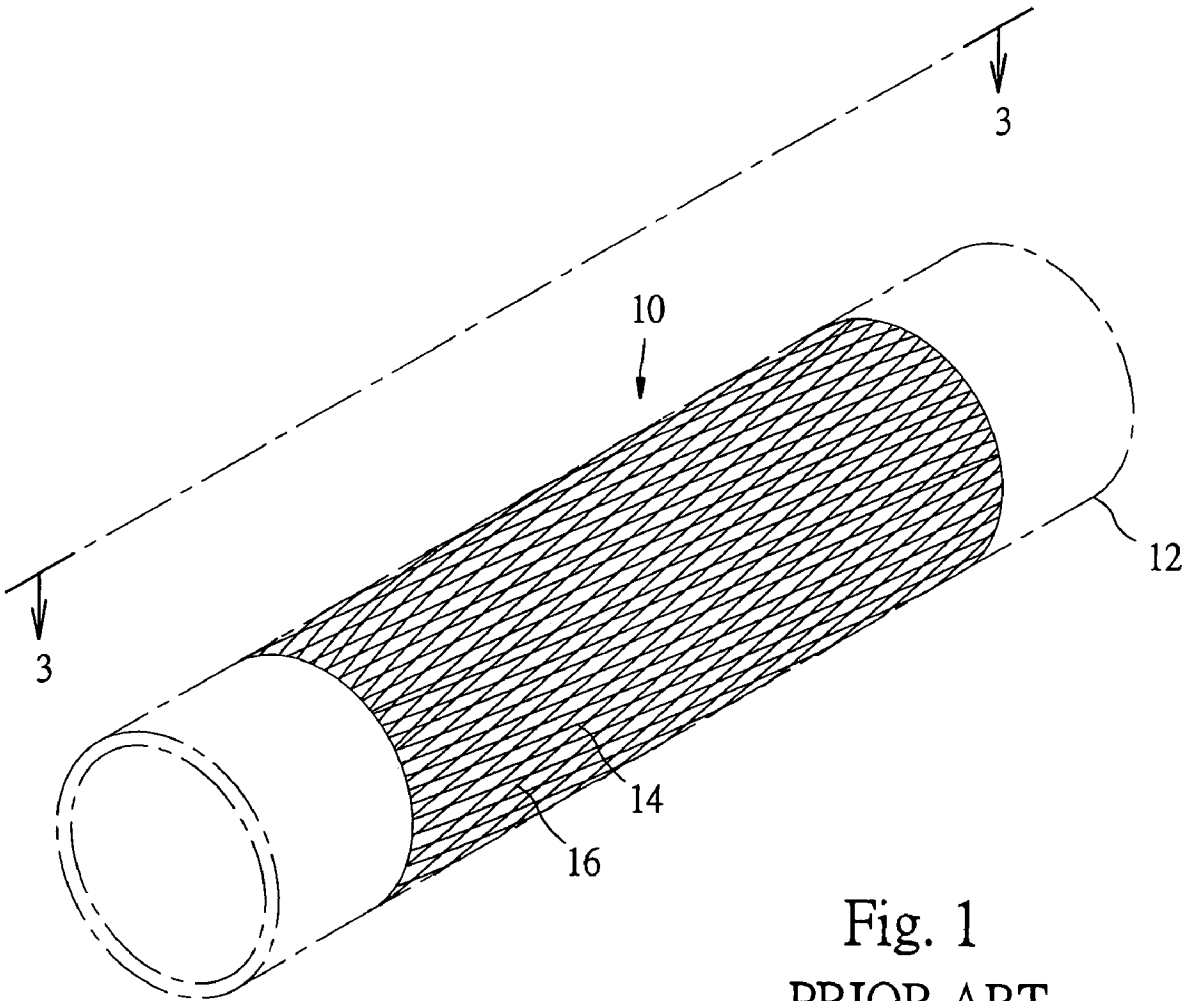
Fig. 1 PRIOR ART
FIG. 1 is a perspective view of a conventional mesh tube fitted around a phantom cylinder.
Figure 2:
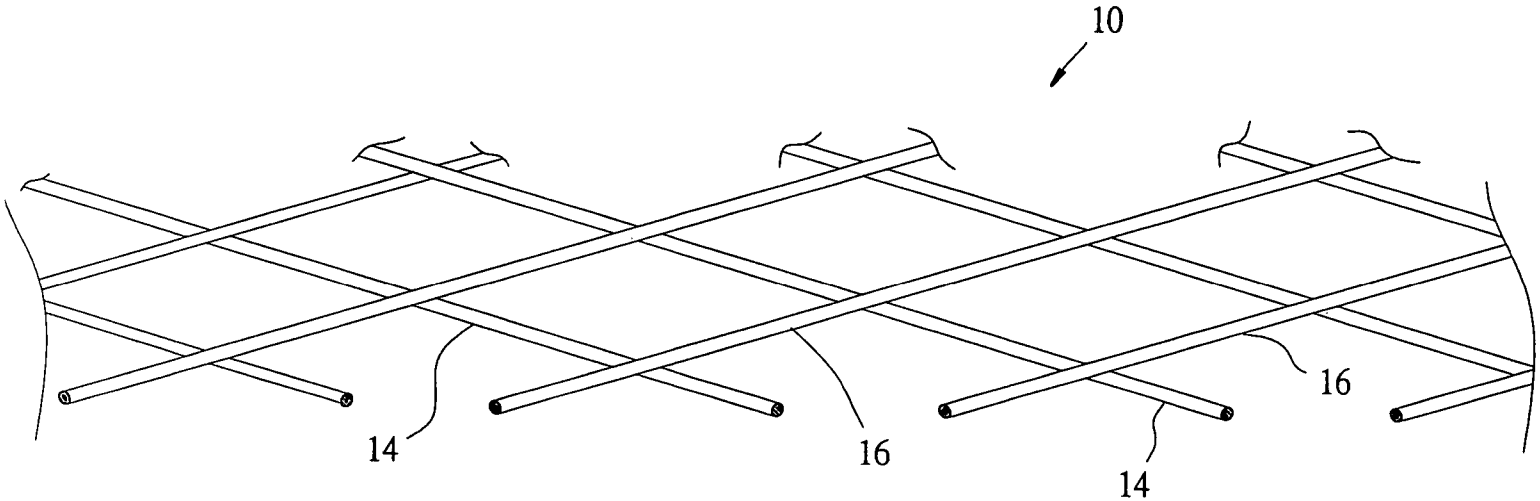
Fig. 2 PRIOR ART
FIG. 2 is an enlarged perspective sectional view of the conventional mesh tube.
Figure 7:
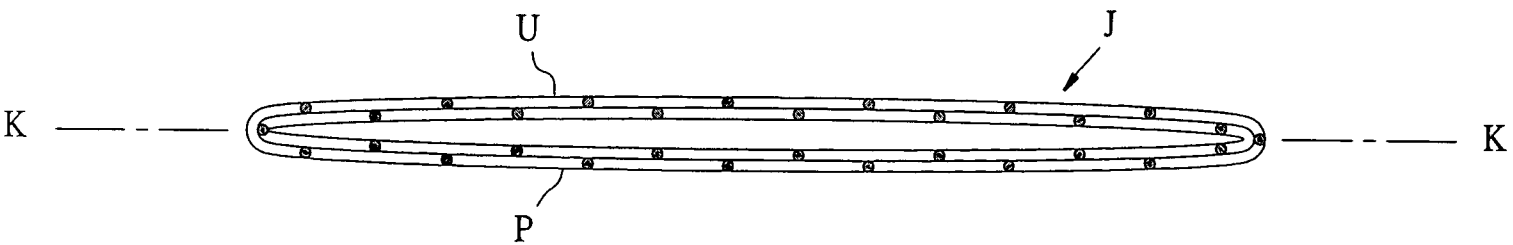
FIG. 7 is an end view of a conventional mesh tube before processed.
Figure 3:
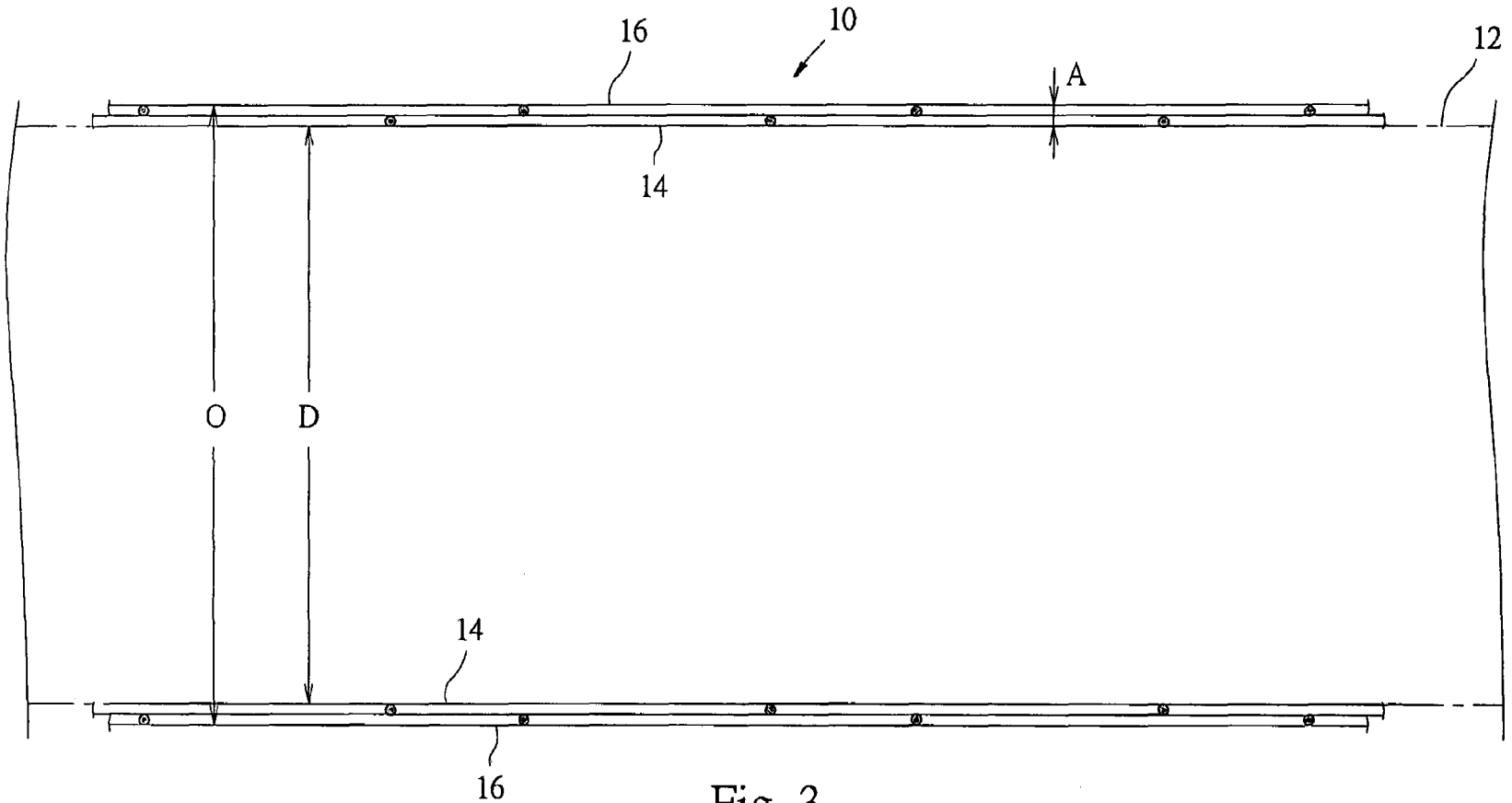
Fig. 3 PRIOR ART
FIG. 3 is a sectional view taken along line 3-3 of FIG. 1.

The mesh tube 20 of FIG. 6 is made from the conventional mesh tube J of FIG. 7 by processing. In FIG. 7, the conventional mesh tube J has a flat shape and can be divided along central line K-K into upper half U and lower half P. When processed and bent, the upper and lower halves are formed with unified wave shapes. Therefore, after the mesh tube is waved into the mesh tube 20 of FIG. 6, on the cross section Q-Q of the same circle of bending section 30, the wave crest 32 of the upper half U corresponds to the wave trough 34 of the lower half P. Reversely, the wave trough of the upper half U corresponds to the wave crest of the lower half P.

Figure 8:
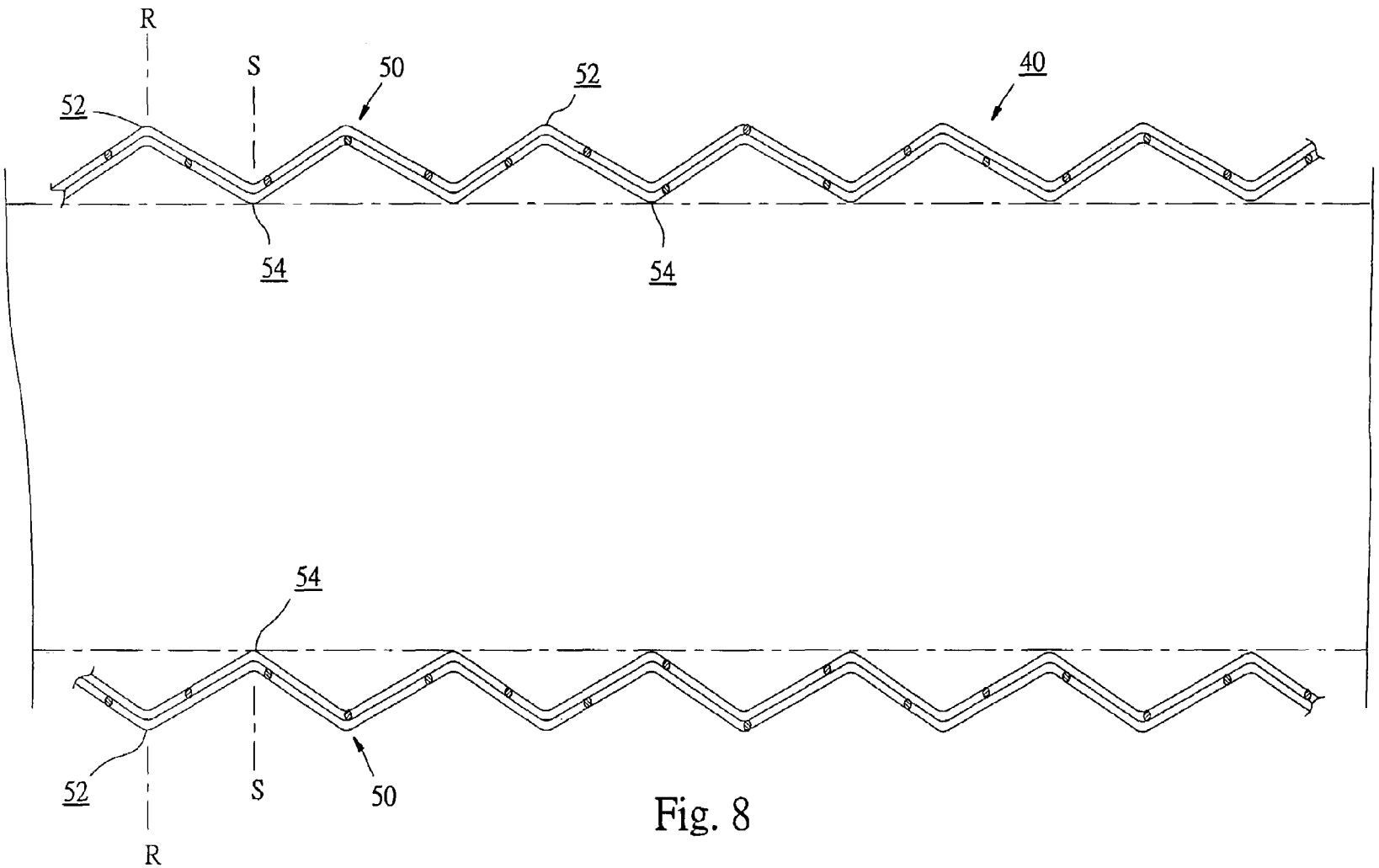
FIG. 8 is a sectional view of another embodiment of the present invention.

FIG. 8 shows another embodiment of the mesh tube 40 of the present invention. A conventional mesh tube in tubular state is processed and formed with continuous circles of waved bending sections 50. The mesh tube is not divided into upper half and lower half. On the cross section R-R of the same circle of bending section 50, all parts of the circle are wave crests 52. On the other hand, on the cross section S-S, all parts of the circle are wave troughs 54.

The mesh tube of the present invention is waved so that it has rigidity higher than that of the conventional mesh tube. A bath ball or bath brush made from such waved mesh tube can provide better rubbing effect for a user's skin to rub off the aged skin.

Figure 9:
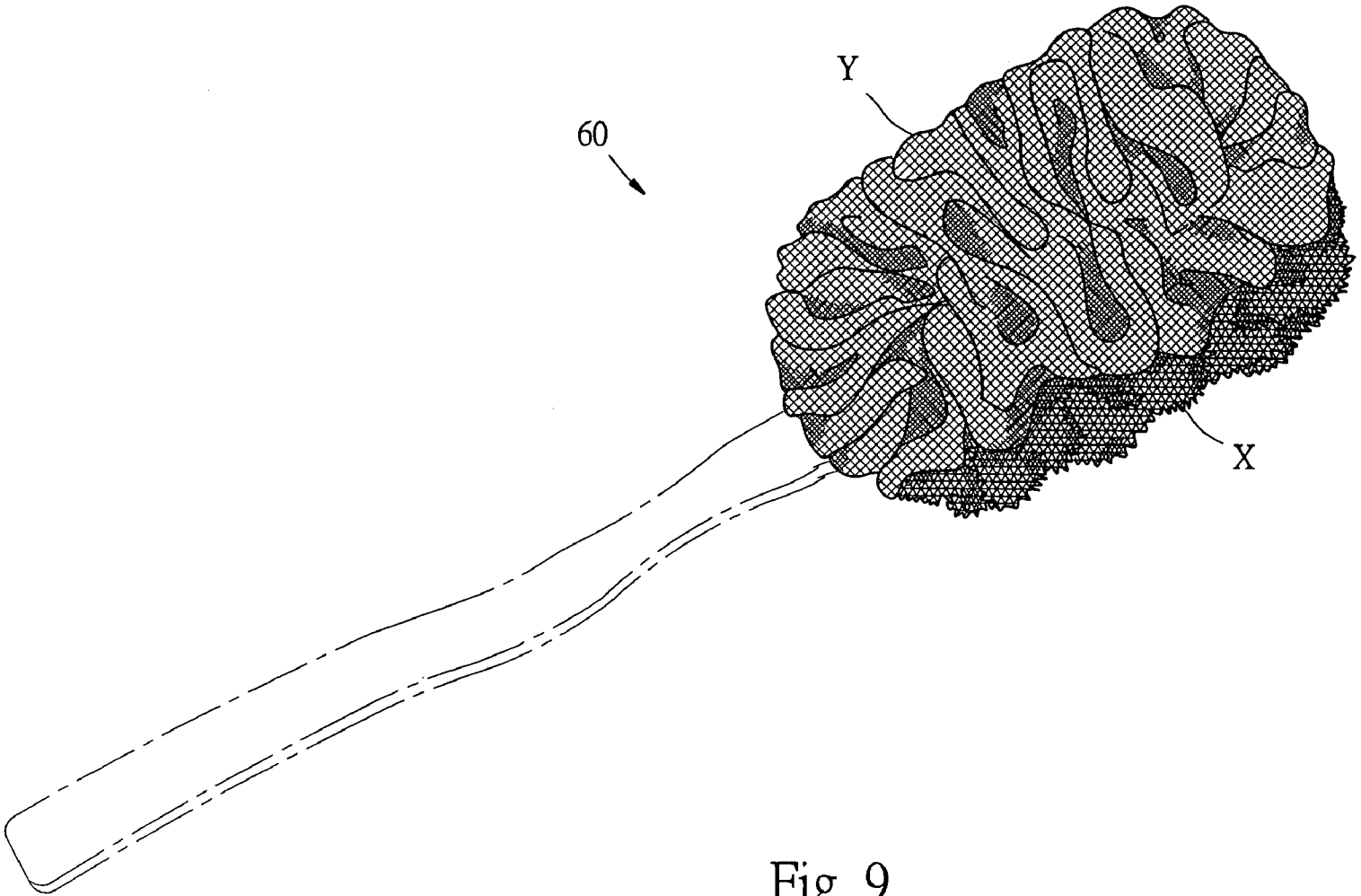
FIG. 9 is a perspective view of a double-mesh bath brush composed of the mesh tube of the present invention and the conventional mesh tube.

FIG. 9 shows a double-mesh bath brush 60 composed of the mesh tube X of the present invention and a conventional mesh tube Y. The mesh tube X of the present invention is more solid and compact. Also, the surface of the mesh tube of the present invention is rougher.

Three photographs are attached to respectively show the mesh tube of the present invention, the conventional mesh tube and a double-mesh bath brush composed of the mesh tube of the present invention and the conventional mesh tube.

The above embodiments are only used to illustrate the present invention, not intended to limit the scope thereof. Many modifications of the above embodiments can be made without departing from the spirit of the present invention.

What is claimed is:

1. A waved mesh tube comprising multiple parallel first strings spirally extending in a first direction and multiple parallel second strings spirally extending in a second direction, the second strings being laid on the first strings; said waved mesh tube being characterized in that: the mesh tube has continuous circles of waved bending sections arranged along an axis of the mesh tube, the bending sections being arranged along entire length of the mesh tube, the mesh tube being formed with the bending sections so that the wall of the mesh tube has multiple wave crests and wave troughs axially adjoining each other, the wave troughs defining an inner diameter of the mesh tube, while the wave crests defining an outer diameter of the mesh tube, a difference between the inner diameter and the outer diameter being a thickness of the wall of the mesh tube; each of the wave crests and the wave troughs having an acute angle, wherein the thickness of the wall of the mesh tube is at least triple a diameter of one string.

2. The waved mesh tube as claimed in claim 1, wherein the bending sections have different sizes.

3. The waved mesh tube as claimed in claim 1, wherein the same circle of a waved bending section is divided into an upper half and a lower half, whereby on a cross section of the circle of the waved bending section, the wave crest of the upper half corresponds to the wave trough of the lower half, while the wave trough of the upper half corresponds to the wave crest of the lower half.

4. The waved mesh tube as claimed in claim 1, wherein on a cross section of the same circle of a waved bending section, all parts of the circle are wave crests or all parts of the circle are wave troughs.

5. The waved mesh tube as claimed in claim 1, wherein the acute angles of the wave crests or wave troughs are small-size arcs.

6. A waved mesh tube comprising multiple parallel first strings spirally extending in a first direction and multiple parallel second strings spirally extending in a second direction, the second strings being laid on the first strings; said waved mesh tube being characterized in that: the mesh tube has continuous circles of waved bending sections arranged along an axis of the mesh tube, the bending sections being arranged along entire length of the mesh tube, the mesh tube being formed with the bending sections so that the wall of the mesh tube has multiple wave crests and wave troughs axially adjoining each other, the wave troughs defining an inner diameter of the mesh tube, while the wave crests defining an outer diameter of the mesh tube, a difference between the inner diameter and the outer diameter being a thickness of the wall of the mesh tube; the waved bending sections having different sizes, wherein the thickness of the wall of the mesh tube is at least triple a diameter of one string.

7. The waved mesh tube as claimed in claim 6, wherein each of the wave crests and the wave troughs having an acute angle.

8. The waved mesh tube as claimed in claim 7, wherein the acute angles of the wave crests or wave troughs are small-size arcs.

* * * * *